US005975151A

United States Patent [19]

Packo

[11] Patent Number: 5,975,151

[45] Date of Patent: Nov. 2, 1999

[54] CHARGING A REFRIGERATOR WITH NON-VOLATILE LIQUID

[75] Inventor: Joseph J. Packo, Vieques, Puerto Rico

[73] Assignee: IPG Corporation, Vieques, Puerto Rico

[21] Appl. No.: 09/130,001

[22] Filed: Aug. 6, 1998

[51] Int. Cl.[6] ..... B65B 1/04

[52] U.S. Cl. ..... 141/3; 141/18; 141/65; 141/66; 141/67; 62/77

[58] Field of Search ..... 141/2, 3, 65, 66, 141/67, 18, 98; 62/292, 77; 73/40.7, 40

[56] References Cited

U.S. PATENT DOCUMENTS

| | | | |
|---|---|---|---|
| 2,964,918 | 12/1960 | Hansen et al. . | |
| 3,636,992 | 1/1972 | Weidner . | |
| 3,937,257 | 2/1976 | Biro . | |
| 4,587,999 | 5/1986 | Boiko et al. . | |
| 4,612,798 | 9/1986 | Roberts . | |
| 4,745,772 | 5/1988 | Ferris | 62/292 |
| 4,754,638 | 7/1988 | Brayman et al. . | |
| 4,791,805 | 12/1988 | Gates . | |
| 4,920,785 | 5/1990 | Etess . | |
| 4,922,973 | 5/1990 | Keneavy . | |
| 4,938,063 | 7/1990 | Leighley . | |
| 5,065,690 | 11/1991 | Bontempo . | |
| 5,070,917 | 12/1991 | Ferris et al. . | |
| 5,167,140 | 12/1992 | Cooper et al. . | |
| 5,409,046 | 4/1995 | Swenson et al. . | |
| 5,440,919 | 8/1995 | Cooper . | |
| 5,450,881 | 9/1995 | Patterson . | |
| 5,574,213 | 11/1996 | Shanley . | |
| 5,603,360 | 2/1997 | Teel . | |
| 5,826,636 | 10/1998 | Trigiani | 141/18 |

OTHER PUBLICATIONS

G. S McCloy and A. W. Haley, "The Bomb Method Of Evacuating and Charging", Jul. 1940.

*Primary Examiner*—David J. Walczak
*Assistant Examiner*—Khoa D. Huynh
*Attorney, Agent, or Firm*—Browdy and Neimark

[57] ABSTRACT

A charging device and method for injecting a non-volatile liquid such as oil or stop-leak into a refrigeration system through a service port, uses a hollow pressure container partly filled with the liquid using system refrigerant as the pressurizing gas. The container has a fitting with a Schrader valve that opens when the fitting is coupled to the service port. The liquid is injected by gas pressure created in the container after coupling. The container may inject the liquid through either the high-side service port or the low-side service port.

17 Claims, 2 Drawing Sheets

G
10
L

30'
20
30
40

CHARGING A REFRIGERATOR WITH NON-VOLATILE LIQUID

FIELD OF INVENTION

The present invention relates to charging refrigeration systems with non-volatile liquids such as lubricants, liquid sealants, leak detection liquids, and the like, or mixtures thereof, without the need of a propellant.

REVIEW OF THE RELATED TECHNOLOGY

Leighley, in U.S. Pat. No. 4,938,063, discloses a device for infusing fluorescent dye (used for leak detection) into a large refrigeration system. The device is basically a container with two concentric and transparent cylindrical walls, the outer of which is a safety wall. There are fluid couplings at both ends. After the transparent cylinder is filled with dye, one end of the container is coupled to the refrigeration system through a port, and the other end is connected to a source of high-pressure refrigerant. A valve at the refrigerant end is opened to permit the high pressure refrigerant to force the dye into the closed refrigeration system through the port.

Another device based on the same principles is shown in U.S. Pat. No. 5,167,140 to Cooper et al. This device also has a transparent container with liquid held inside, a coupling to the refrigeration system at one end, and a pressure connection at the other end for connection to a propellant.

The prior art does not disclose any self-contained device for charging a non-volatile liquid into a refrigeration system without a propellant gas. All the known devices require an external source of pressure.

SUMMARY OF THE INVENTION

Accordingly, the present invention has an object, among others, to overcome deficiencies in the prior art, such as noted above.

The invention relates to a method (and device) for charging a refrigerating system with a non-volatile liquid. The device comprises a strong-walled charging container partly filled, e.g. 20–30%, with the charging liquid and some gas inside. The gas can be any refrigerant-compatible gas, e.g. not moisture laden air, but is preferably the same refrigerant as is in the refrigerating system. The container includes at least one fitting for coupling with a service port of the refrigeration system, either a low-side service port or a high-side service port.

In use, the strong-walled charging container is placed in an inverted position, with the fitting downward, and coupled to the low-side service port of the refrigerating system. Upon opening the valve to the low-side of the AC or refrigeration system, the gas pressure equalizes on both sides of the port. Upon turning on the compressor, the low-side pressure within the circuit becomes lower than the pressure within the container, whereby the gas inside the container pushes the non-volatile liquid from the lower part of the container through the service port and into refrigerating system. As the charging gas expands, its pressure drops. When the pressures of the gas in the charging container is equal to the system pressure, the flow stops. By this time the liquid is largely or entirely expelled from the charging container into the system.

The fitting includes a check valve, such as a Schrader valve, to keep the liquid and gas sealed inside the charging container until it is fitted to the system port. Preferably, only one fitting is provided. The gas and liquid are both injected through the sole fitting and then exit when the device is attached to the service port and the respective container and service port valves are opened.

The charger may alternatively have fittings at both ends, or multiple fittings of different types at one end so as to adapt to different refrigeration service ports.

The device can also be used on the high-side port. The system compressor is used to increase the pressure inside the container by forcing refrigerant vapor into the container through the fitting. When the compressor is then turned off, the high-side pressure slowly drops as pressure equalizes within the system. The decreasing pressure in the high side of the system sucks the liquid out of the container in which the refrigerant is still at a higher pressure, which refrigerant has been pressurized to the compressor-on high-side pressure, into the system.

The device is preferably elongate with only a single fitting at one end.

BRIEF DESCRIPTION OF THE DRAWING

The above and other objects and the nature and advantages of the present invention will become more apparent from the following detailed description of an embodiment taken in conjunction with drawings, wherein.

DETAILED DESCRIPTION OF THE PREFERRED EMBODIMENT

Figures 1, 1A:
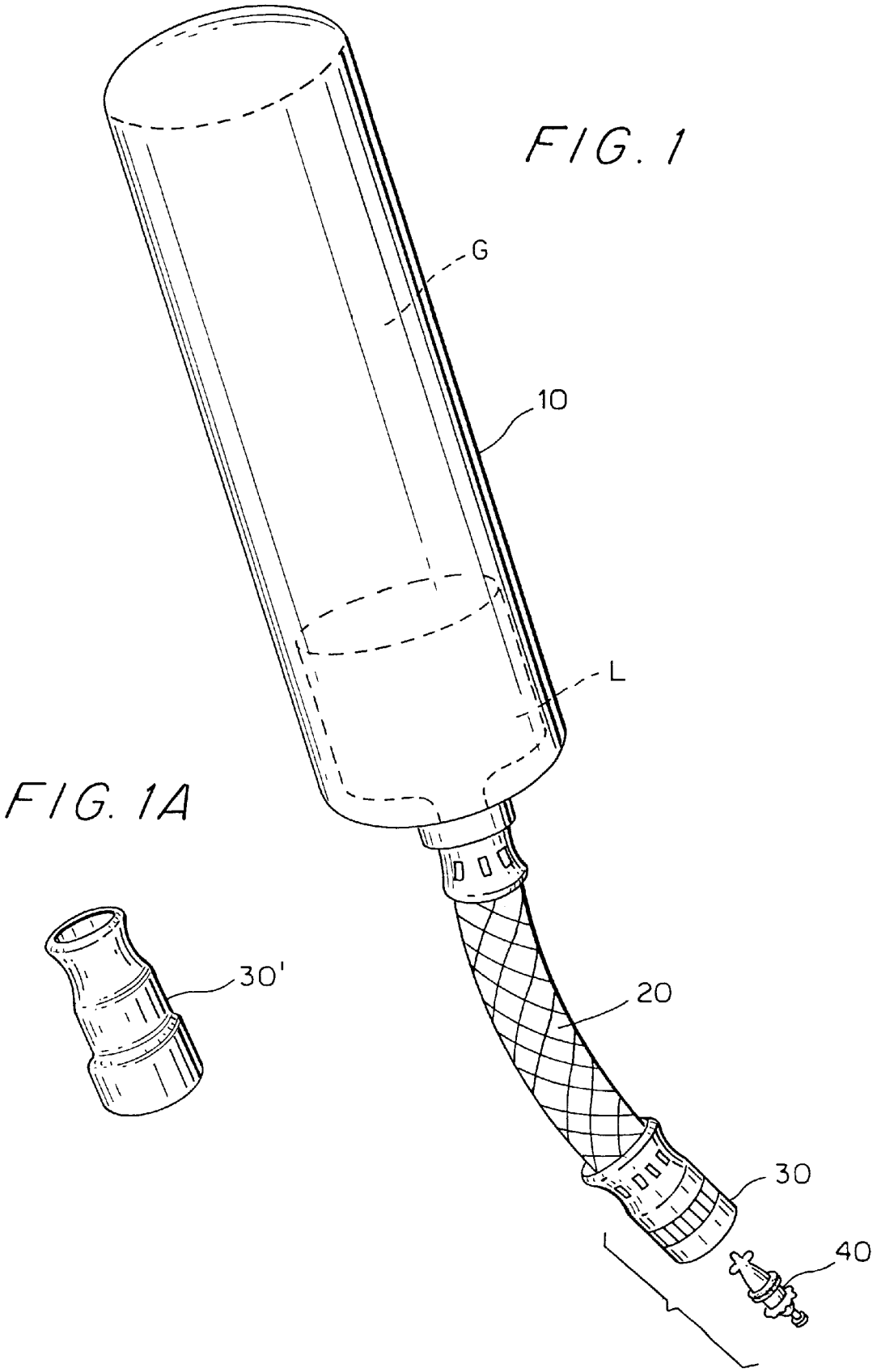
FIG. 1 is a perspective view of a device according to the present invention.
FIG. 1A is an alternative embodiment of a detail.

A preferred embodiment of the device of the present invention is shown in overview in FIG. 1. A pressure container 10 is a cylinder of steel or other strong material able to safely contain the high pressure of a refrigeration system, e.g. constructed to resist 450 psi. The preferred dimensions are about five inches (13 cm) long by one inch (2.5 cm) diameter, although variations in size are permissible without departing from the invention.

The interior is hollow, filled with a non-volatile liquid L preferably to about 20% of its total volume. Variations in this volume percentage are permissible without departing from the invention, so long as sufficient space is provided in the container, not occupied by the liquid, to permit an adequate quantity of refrigerant gas to flow into and occupy such space from the circuit. A gas G may also be introduced into the empty space to act as a blanket to prevent the entry of moisture. The gas is preferably the same refrigerant which is used in the refrigerating system (not shown in FIG. 1) to which the device is to be connected, but may include or consist of any other compatible gas. The pressure of the gas G may depart from atmospheric pressure, but there is no advantage in doing so; if the gas G is at above atmospheric pressure, such pressure should not exceed about 30 psig because the gas is not intended to be a propellant.

At a draining end (the lower end of the pressure container 10 shown in FIG. 1), a flexible hose 20 is coupled to the container 10, such that fluid can flow through the hose 20. At the other end of the hose 20 a fitting 30 is attached. The fitting 30 mates with a refrigeration system service port (not shown in FIG. 1; see FIG. 2) and will preferably be one of the "snap-on" types approved for refrigeration systems. The hose 20 may be eliminated and the fitting 30 mounted right on the pressure container 10 for some applications.

The fitting 30 preferably includes a valve 40, such as a Schrader valve or equivalent, that seals pressurized fluids inside the container 10 until the valve is opened by the fitting being attached to the service port of the refrigeration system and the port valve is also opened. FIG. 1 shows the Schrader-type valve 40 exploded out of the fitting 30, removed for illustration by, e.g., unscrewing it.

Alternatively, the fitting may include a stop-cock or other manually-operated type of valve, mounted either in the fitting 30, between the hose 20 and the container 10, or elsewhere, or incorporated into the fitting 30. An alternative fitting 30' is shown in FIG. 1A.

Figure 2:
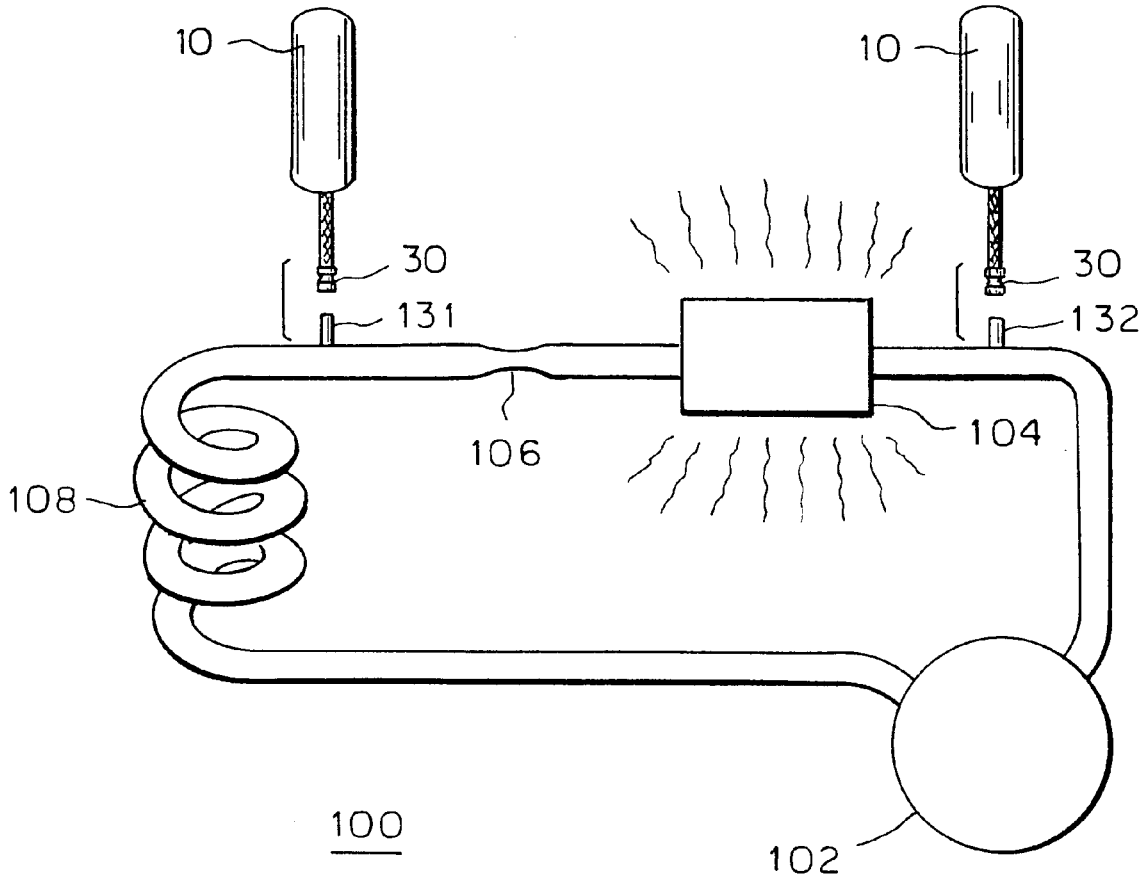
FIG. 2 is a schematic view of the invention in use.

FIG. 2 shows the pressure container 10 in two coupling positions in relation to a refrigerating system 100. The system 100 includes a compressor 102, which pressurizes the high side (high-pressure side). The high side includes a high-side service port 132, and a heat radiator 104, usually called a condenser. Compressed liquid refrigerant flows from the compressor 102 through the radiator 104 to a nozzle 106, usually called a capillary tube or expansive tube or valve, where the refrigerant expands into the low side (low-pressure side), passes through the refrigerating coils 108, usually called an evaporator, and returns to the compressor 102. The system has a low-side service port 131.

The system may be charged with the non-volatile liquid L at either port.

To charge via the low-side port 131, the fitting 30 is coupled to the port 131 while the container 10 is inverted. If the valve 40 is of the automatic, e.g. Schrader type, then as soon as the coupling is completed the valve 40 will open. The port valve also needs to be opened so as to provide communication between the container 10 and the low side of the circuit. This causes equalization of the gas pressures within the container and within the circuit. The compressor 102 is then turned on, reducing the pressure on the low side of the circuit. With the container 10 inverted, the pressure of the gas G plus the refrigerant which has entered the container forces the liquid L into the system 100.

Even before the compressor 102 is turned on, the pressure in the low side will be relatively high but the gas G, if initially at a higher pressure, will force at least part of the liquid L into the system 100. When the gas G is initially at about atmospheric pressure, as is preferred, in order to ensure that all of the liquid L is injected into the system 100, the compressor 102 must then be turned on, causing the low-side system pressure to drop and the remainder of the liquid L to enter the system 100. (Of course, if sufficient gas G was in the container 10 prior to beginning the procedure all the liquid L will already have been injected before the compressor 102 was turned on.)

To charge the system 100 via the high-side port 132, the fitting 30 is coupled to that port, again preferably while the container 10 is inverted—but only after the compressor 102 has been turned off for a time long enough to ensure a relatively low high-side pressure through internal equalization. Once the high- and low-side pressures equalize, and after coupling of the container 10 to the high side, the compressor 102 is turned on thus increasing the high side pressure and thus pressurizing the container 10. This recharges the container to the working high-side pressure. When the compressor 102 is then turned off again, lowering the high-side pressure, the fresh charge of refrigerant gas in the container will flush all the remaining liquid L into the system 100 as the pressure on the other side of the port 132 drops through internal system pressure equalization.

It will be apparent that the container 10 needs no gas G initially, and may in fact be evacuated except for the non-volatile liquid L. Refrigerant may be fed into the container 10 by the system 100 to act as the initial gas G. However, the invention is not dependent on the initially present gas G, but instead on the refrigerant gas from the circuit after coupling of the container 10 to the circuit. Once pressurized at the high-side port 132, the container 10 will be able to charge the system 100 at the low side port 131. Moreover, if the container is initially charged with gas G merely to atmospheric pressure, that will in most systems be sufficient using the present method to permit liquid injection into the low-pressure side of the system 100.

Preferably, the container 10 is charged with gas G which is the same as the system refrigerant, since this avoids all problems with excess non-condensable gas in the system, or mixing of refrigerants. Alternatively, an inert or inactive gas may be used. The fitting 30 is preferably adapted to mate with a specific service port valve design, for example R-134A, R-12, R-22, and with a so-called "unique" Federally-regulated fitting design for each type of refrigerant, and the gas G and the fitting type are preferably matched to avoid inadvertent mixing of refrigerants by injecting a different refrigerant into the system 100.

The following examples are offered to further illustrate, but not limit, the present invention:

EXAMPLE 1: The present method is used to create the propelling pressure in the container 10 by attaching the container to the low side service port of an air conditioning circuit. The pressure in the air conditioning circuit equalizes with the container to approximately 83 psig at 72@F using an R-12 refrigerant. The compressor is turned on and the pressure at the low side of the circuit lowers to approximately 40 psig causing the higher pressure in the container 10 to eject the liquid into the low side of the air conditioning circuit.

EXAMPLE 2: Example 1 is repeated by attaching the container 10 to the high side of the air conditioning circuit. The compressor is turned on to pressure up the container. Then, after a short time, the compressor is turned off allowing the pressure on the high side of the system to lower by equalizing to the low side of the circuit, thereby drawing in the non-volatile liquid in the lower part of the container.

For use with air conditioning and refrigeration system in which the ports do not extend upwardly, the container 10 may be modified by the incorporation of a dip tube. Under such circumstances, the container 10 will be used to dispense the non-volatile liquid while it is disposed in the upright rather than inverted position.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

The means and materials for carrying out various disclosed functions may take a variety of alternative forms without departing from the invention. Thus the expressions "means to . . . " and "means for . . . " as may be found in the specification above and/or in the claims below, followed by a functional statement, are intended to define and cover whatever structural, physical, chemical or electrical element or structure may now or in the future exist for carrying out recited function, whether or not precisely equivalent to the embodiment or embodiments disclosed in the specification above; and it is intended that such expressions be given their broadest interpretation.

What is claimed is:

1. A charging device for injection into a refrigeration or air conditioning system through a service port of the refrigeration or AC system, the device comprising:

a hollow pressure container having a draining end;

a non-volatile liquid disposed within the container; but not filling the container;

a fitting at the draining end including a connector removably fastenable to the service port of the refrigeration or air conditioning system; and a valve associated with the fitting to control flow of the liquid through the fitting, whereby refrigerant gas forces the non-volatile liquid into the refrigeration or air conditioning system when the container is oriented to permit draining of the liquid, the fitting is fastenable to a service port of the system and thereby communication is established between the system and the container so that refrigerant gas flows into the container.

2. The charging device according to claim 1, wherein the container also contains a refrigerant.

3. The charging device according to claim 2, wherein the fitting is a type associated with the refrigerant.

4. The charging device according to claim 1, wherein the container is charged approximately 10–30% full by volume with the non-volatile liquid.

5. The charging device according to claim 1, including a plurality of fittings adapted for service ports associated with various different refrigerants.

6. The charging device according to claim 1, wherein the valve includes an opener for opening the service port when the fitting is fastened to the service port.

7. The charging device according to claim 6, wherein the opener includes an automatic valve automatically openable by fastening to the service port.

8. The charging device according to claim 7, wherein the automatic valve includes a Schrader valve.

9. The charging device according to claim 8, including a dip tube attached to said Schrader valve.

10. A method of injecting a refrigeration or air conditioning system with a non-volatile liquid through a service port of the refrigeration or air conditioning system, the method comprising:

attaching to a port of the system, a hollow container capable of being pressurized and including a fitting at a draining end thereof and partially filled with a non-volatile liquid, said hollow container further comprising a connector for removably fastening said draining end to a service port of the refrigeration or air conditioning system, and a valve associated with the fitting to control flow of liquid through the fitting;

communicating the container interior with the interior of the refrigeration or air conditioning system;

pressurizing the container with refrigerant gas from the air conditioning or refrigeration system; and causing pressurized gas from said system and transferred to said container to drive said non-volatile liquid into said system.

11. The method according to claim 10, wherein said hollow container initially contains some refrigerant.

12. The method according to claim 10, wherein the fitting is a type associated with the type of refrigerant of the system.

13. The method according to claim 10, wherein the fitting is a type associated with a particular refrigerant.

14. The method according to claim 10, wherein the container is initially approximately 10–30% full by volume with the non-volatile liquid.

15. The method according to claim 10, comprising attaching and communicating said container with the low-pressure end of the refrigeration or air conditioning system; and wherein said step of driving the liquid from the container to the system is effected by turning on a compressor of said system.

16. The method according to claim 10, wherein said container is attached to and communicated with a high-side of said system; and wherein non-volatile liquid is driven from said container to said system by turning off a compressor of said system.

17. The method according to claim 10, comprising a preliminary step of turning "on" the compressor after the container is attached to increase pressure in the container, then turning "off" the compressor to allow the refrigeration system to equalize, thereby sucking in the non-volatile liquid.

* * * * *